US006209509B1

(12) United States Patent
Kammeraad et al.

(10) Patent No.: US 6,209,509 B1
(45) Date of Patent: Apr. 3, 2001

(54) BEARING INSERT FOR SUPPORTING ROTATABLE SHAFTS, METHOD OF REPAIR, AND RELATED BROACH TOOL

(75) Inventors: James A. Kammeraad; Thomas W. Knowles, II, both of Holland; Dwain L. Kamphuis, West Olive, all of MI (US)

(73) Assignee: K-Line Industries, Inc., Holland, MI (US)

( * ) Notice: Subject to any disclaimer, the term of this patent is extended or adjusted under 35 U.S.C. 154(b) by 0 days.

(21) Appl. No.: 09/301,629

(22) Filed: Apr. 29, 1999

(51) Int. Cl.[7] ..... F01M 9/10
(52) U.S. Cl. ..... 123/196 R; 123/90.6
(58) Field of Search ..... 123/196 R, 90.6, 123/198 E

(56) References Cited

U.S. PATENT DOCUMENTS

| | | | | |
|---|---|---|---|---|
| 3,958,541 | * | 5/1976 | Lachnit | 123/196 R |
| 4,441,243 | * | 4/1984 | Stojek | 123/90.6 |
| 5,778,841 | * | 7/1998 | Reedy et al. | 123/90.6 |
| 5,979,386 | * | 11/1999 | Swars | 123/90.6 |

* cited by examiner

*Primary Examiner*—Tony M. Argenbright
*Assistant Examiner*—Jason Benton
(74) *Attorney, Agent, or Firm*—Price, Heneveld, Cooper, Dewitt & Litton

(57) ABSTRACT

A cam shaft bearing insert is provided for use in a cam shaft support bearing for operably supporting a cam shaft in an internal combustion engine. The engine includes a cylinder head with bearing support towers that operably support journals on the cam shaft at multiple aligned bearing locations. Each bearing support tower has an oil port for passing oil to the associated journal. The bearing insert further has a thin-walled cylindrical sleeve formed from thin flat stock into a cylindrical tubular shape that is adapted to fit into one of the bearing support structures and form a bearing surface suitable for supporting the cam shaft. The sleeve has an outer surface with an outwardly deformed area configured to non-rotatably engage the one bearing support structure and has an aperture therein so that, when the aperture is aligned with the oil port of the one bearing support structure, oil can pass from the oil port to the associated bearing location. The sleeve includes a longitudinal slit allowing the sleeve to flex outwardly to slip onto a journal of the cam shaft and then flex inwardly into one of the bearing support structures of the cylinder head. A broaching tool is provided that is adapted to be linearly pulled through the aligned bearing locations to reform the bearing support structures in preparation for receiving one of the bearing inserts. A method of repair includes enlarging at least one cam shaft support bearing to an oversized condition, such as by using the broach, repairing the oversized cam shaft support bearing by filling voids and galled areas with a thermal setting polymer, as needed, positioning a bearing insert on the cam shaft, and positioning the cam shaft including the bearing insert in the cam shaft support bearing with the cam shaft being rotatably supported in the bearing insert and the bearing insert being secured to the oversized cam shaft support bearing.

12 Claims, 5 Drawing Sheets

D2
D1
41A
43
41
42
40A
40
27
46
45
23
33
26
25
20
51
88
85
83
84
80
82
86
81
87

BEARING INSERT FOR SUPPORTING ROTATABLE SHAFTS, METHOD OF REPAIR, AND RELATED BROACH TOOL

BACKGROUND OF THE INVENTION

The present invention relates to bearing inserts for operably supporting a rotatable shaft, such as a cam shaft in an internal combustion engine, and further relates to a method for repairing spaced-apart bearing supports to receive the bearing inserts, and still further relates to a broaching tool for use in the method.

Modern internal combustion engines for passenger vehicles typically include a cylinder head and a cam shaft rotatably supported at journals by the cylinder head at multiple aligned bearing locations. The cylinder heads include a bearing support structure (sometimes called "bearing housings") at each of the bearing locations. An oil port is included in each bearing support structure for passing oil to journals on the cam shaft. As engines age, the bearing surfaces on the cylinder head and the journals on the cam shaft wear, such that these bearing locations sometimes need to be rebuilt. In extreme cases, galling and material deformation may occur, causing the cam shaft to roughly rotate or even freeze up on the cylinder head. It is known to repair these bearing locations by welding on the cylinder head to reapply material to the support structure, and thereafter to machine away excess material to reform the bearing surfaces. It is also known to simply machine away material on the cylinder head to form an oversized bearing surface. A problem is that accurate alignment of the bearing locations along a cam shaft is very important so that the cam shaft is properly positioned for rotation without stress, and so that the intake and exhaust valves of the internal combustion engine work properly. Set up for good alignment to recut the bearing locations is expensive and time consuming and can easily be done wrong. Further, the tools for cutting and machining the bearing locations can be expensive. Also, a plurality of different tools is required for each different bearing size, such that it requires significant capital investment for a repair shop. There are also the frustrations of not having (or not being able to find) the right size cutting tool for a particular size bearing.

It is known to cutaway the bearing support structure and to locate a whole new massive outer bearing in the cylinder head to support the cam shaft. Further, it is known to purchase new replacement cam shafts having particular sized cam shaft bearing surfaces. However, it is undesirable to cutaway substantial material from the cylinder head of modern engines since this can affect their strength, operation, and heat flow in the cylinder head in adverse ways. Further, removal of large amounts of material can lead to mistakes that totally destroy cylinder heads.

Notably, inserts have been used on valve guides for supporting linear movement of intake and exhaust valves on internal combustion engines for many years. For example, see U.S. Pat. Nos. 4,768,479 and 5,249,555. However, despite this type of engine repair for several years, no one has, to the inventor's knowledge, ever conceived of using thin-walled inserts in cam shaft bearings because different problems are presented. One such problem is that existing cam shaft constructions require that oil be injected from a side of the cam shaft bearing area so that oil reaches and lubricates the journals of the cam shaft. Further, it is difficult to retain a thin-walled insert in a cam shaft bearing arrangement due to the torsional forces on a cam shaft bearing, both in terms of preventing rotation of the insert and also preventing longitudinal creeping of the insert during use.

Accordingly, there is a need for a reliable bearing insert and a related method and tools that solve the aforementioned problems and that have the aforementioned advantages.

SUMMARY OF THE INVENTION

In one aspect, the present invention includes a cam shaft bearing insert for use in an internal combustion engine, where the engine includes a cylinder head and a cam shaft rotatably supported by the cylinder head at multiple aligned bearing locations. The cylinder head includes a bearing support structure at each of the bearing locations and has an oil port in each bearing support structure for passing oil to the associated bearing location. The cam shaft bearing insert includes a thin-walled cylindrical sleeve formed from thin flat stock into a cylindrical tubular shape that is adapted to fit into a selected one of the bearing support structures and form a bearing suitable for operably engaging and supporting the cam shaft. The sleeve has an outer surface shaped to non-rotatably engage the one bearing support structure and has an aperture therein so that, when the aperture is aligned with the oil port of the one bearing support structure, oil can pass from the oil port to the associated bearing location.

In another aspect, the present invention includes a bearing insert for use in an internal combustion engine, where the engine includes a cylinder head and a cam shaft rotatably supported by the cylinder head at multiple aligned bearing locations. The cylinder head includes a bearing support structure at each of the bearing locations. The cam shaft bearing insert includes a thin-walled cylindrical sleeve formed from thin flat stock into a cylindrical tubular shape that is adapted to fit into one of the bearing support structures and form a bearing suitable for operably engaging and supporting the cam shaft. The sleeve has a deformable wall that, as installed, includes a cylindrically shaped major section and an outwardly formed minor section, with the outwardly formed minor section being configured to non-rotatably engage the one bearing support structure.

In another aspect, the present invention includes an internal combustion engine including a cylinder head and a cam shaft rotatably supported by the cylinder head at multiple aligned bearing locations. The cylinder head includes a bearing support structure at each of the bearing locations. The internal combustion engine also includes a resilient cylindrical sleeve positioned in one of the bearing locations and rotatably engaging the cam shaft. The sleeve is formed from thin flat stock into a cylindrical tube with a longitudinal slit and is made from material suitable to form a durable bearing for the cam shaft, but further is resilient so that the sleeve can flex to open up the slit, allowing the sleeve to slip onto the cam shaft at a selected one of the bearing locations, and to then reversely flex to fit into a selected one of the bearing support structures.

In yet another aspect, the present invention includes a broaching apparatus for use in a structural body having spaced-apart bearing supports with aligned holes defining an axis. The broaching apparatus includes an elongated broach having a longitudinally extending hole extending from end to end of the broach and having first threads formed along at least a portion of the longitudinally extending hole. The broach has a lead section, a cutting section, and a tail section. The cutting section is configured to enlarge the aligned holes from a smaller first diameter to a larger second diameter, and the lead and tail sections are configured to guide the broaching tool linearly through the aligned holes while maintaining accurate alignment with the aligned holes. The broaching apparatus further includes a motivating device including a broach puller and a holder rotatably receiving the broach puller. The broach puller has a shaft that extends through the holder with second threads on one end configured to mateably engage the first threads. The broach puller further has a configured end opposite the one end that is shaped to be engaged and rotatably driven by a hand tool. The holder includes a first end section rotatably abutting the configured end of the broach puller and a second end section configured to abut the structural body. Thus, the aligned holes in the structural body can be broached by pulling the elongated broach through the aligned holes by rotating the broach puller.

In another aspect, the present invention includes a cylinder head for an internal combustion engine. The cylinder head includes a cam shaft having journals, and further having spaced-apart bearing housings configured to operably support the journals. The bearing housings each include a bearing base and a bearing cap bolted to the bearing base to define aligned holes. The bearing base includes a first oil port for passing oil to the associated cam shaft journals. At least one of the bearing housings further includes a thin-walled bearing insert that is positioned in the one bearing housing. The thin-walled bearing insert includes a second oil port aligned with the first oil port in the associated bearing base of the one bearing housing for allowing the oil to pass from the associated bearing base through the bearing insert to the associated cam shaft journal. The bearing insert is non-rotatably held in the one bearing housing, with the cam shaft being rotatably supported in the bearing insert in the cylinder head.

In another aspect, the present invention includes a method of repair comprising steps of providing a cylinder head for an internal combustion engine having spaced-apart bearing housings configured to rotatably support a cam shaft, one of the cam shaft bearing housings having a galled, non-uniform bearing surface in need of repair; enlarging the non-uniform bearing surface to a slightly oversized condition to form an enlarged bearing housing; and positioning a thin-walled insert on the cam shaft and in the enlarged bearing housing and frictionally retaining the thin-walled insert in place in the enlarged bearing housing and rotatably supporting the cam shaft in the thin-walled insert.

In yet another aspect, the present invention includes a method of repair comprising steps of providing a cylinder head having spaced-apart and aligned bearing housings configured to rotatably support a cam shaft, the cam shaft bearings being in need of repair, and providing a broach configured to be pulled linearly through the aligned bearing housings to enlarge a diameter of the cam shaft bearing housings. The method further includes broaching at least one of the cam shaft bearing housings to an oversized diameter by pulling the broach linearly through the at least one bearing housing, and positioning at least one insert on the cam shaft and in the at least one bearing housing with the cam shaft being rotatably supported in the insert.

In another aspect, the present invention includes a method of repair comprising steps of providing a cylinder head having spaced-apart bearing housings that define aligned cam shaft bearings configured to rotatably support a cam shaft, one of the cam shaft support bearings being galled and in need of repair. The method further includes reforming the one cam shaft bearing to a predetermined diameter, including applying a polymeric material to the one cam shaft bearing to form a continuous, uninterrupted bearing support surface with an oil port therein, and positioning a cam shaft rotatably in the cam shaft support bearings including the reformed one cam shaft bearing. In a narrower form, the method includes placing a thin-walled bearing insert in the one cam shaft bearing.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 1:
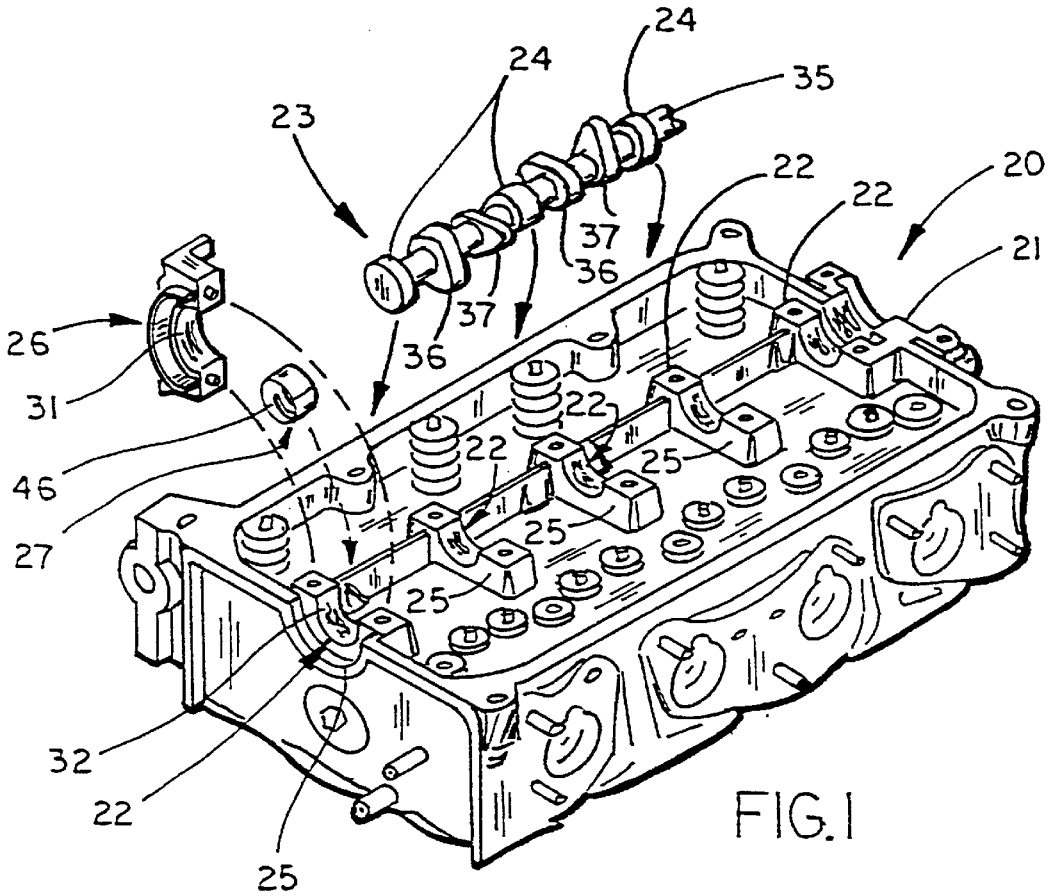
FIG. 1 is a perspective view of a cylinder head having a damaged front bearing, the bearing cap on the front bearing being exploded away to better show the front bearing.

A cylinder head 20 (FIG. 1) of an internal combustion engine comprises a machined casting 21, such as aluminum or cast iron, that is particularly configured to operably support various engine components. Such cylinder heads and engine components, as well as the functions that each provide, are generally known in the art, such that they do not need to be described for an understanding of the present invention. The present cylinder head 20 includes a plurality of bearing support structures or cam housings 22 that define multiple aligned cam bearing locations along a common axis. The bearing support structures 22 each define aligned holes configured to rotatably support a cam shaft 23 on its journals 24. The bearing support structures 22 include a bottom half 25 formed as part of the casting 21 of the cylinder head 20, and further include a top half or bearing cap 26 secured to the bottom half 25. A cam shaft bearing insert 27 is constructed to friction fit into selected ones of (or all of) the bearing support structures 22 to rotatably support the cam shaft 23. The bearing insert 27 can be used in original castings 21 in new engines, such as to provide a more durable bearing housing at the journals 24, or can be used in repair procedures to rebuild worn engines, as described below.

Figure 6:
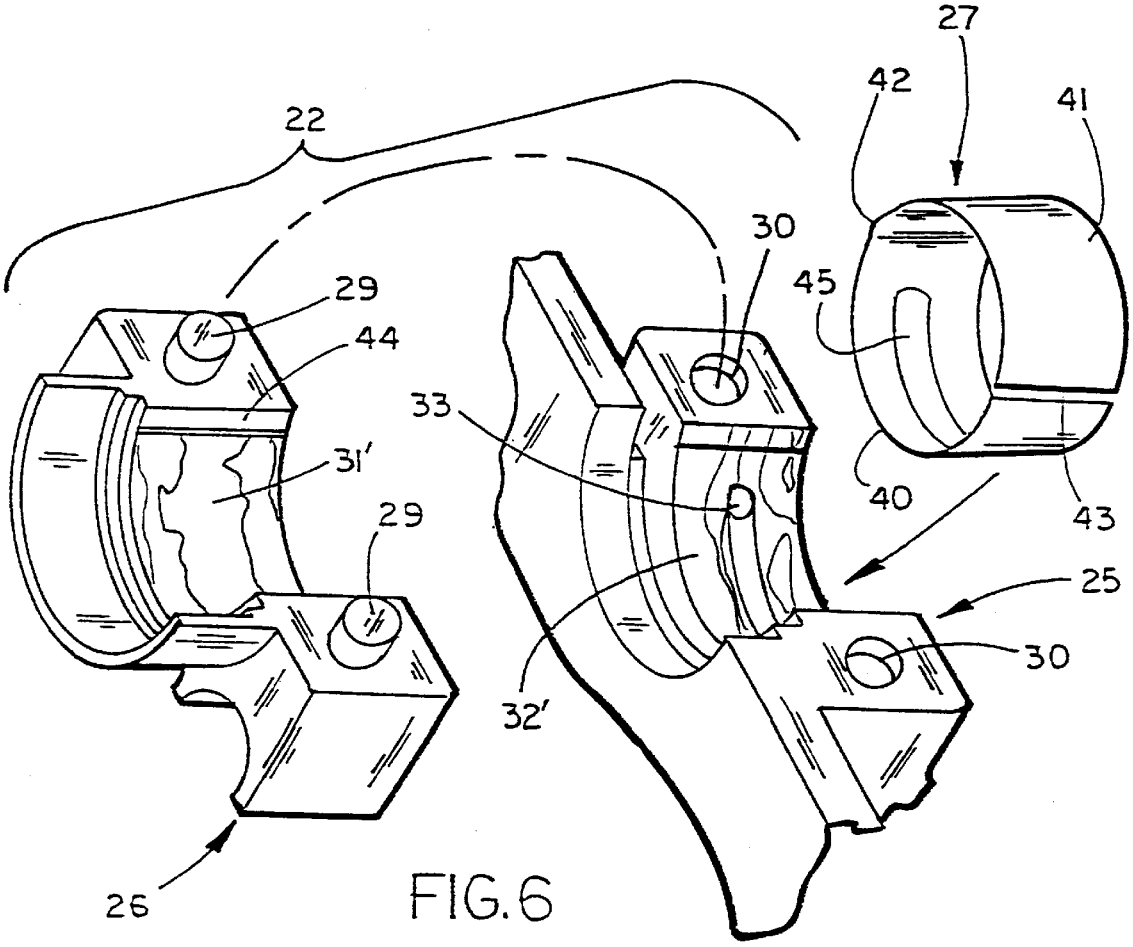
FIG. 6 is an exploded perspective view of the bearing cap and bottom forming an epoxy-repaired bearing housing.

Bearing support structures 22 (FIG. 6), often called cam housings, each comprise a bearing top cap 26 secured to a bearing bottom half 25. The illustrated top cap 26 includes tubular alignment projections 29 that engage mating locating holes 30 in the bottom half 25. The illustrated top cap 26 is secured to the bottom half 25 by bolts that extend through tubular projections 29 threadably into the holes 30. The top cap 26 and bottom half 25 include semi-cylindrical surfaces 31 and 32, respectively, that join to form axially aligned holes across a top of the cylinder head 20. The bottom half 25 includes an oil port 33 formed between its side edges that is operably connected to a source of engine oil. The oil port 33 is configured to deliver engine oil to the bearing location for lubricating the journal 24 on the cam shaft 23 as the cam shaft 23 rotates. The illustrated oil port 33 is circumferentially elongated, but it is noted that different oil port designs are known, including a single hole design or a design including spaced holes, and that the present inventive concepts will work with alternative designs.

Cam shaft 23 (FIG. 1) is elongated and includes a main shaft 35 with a plurality of axially aligned journals 24 accurately positioned on and spaced apart along the main shaft 35. Intake and exhaust cams 36 and 37, respectively, are positioned along the main shaft 35 between the journals 24 for operating valve rockers (not shown) which in turn operate intake and exhaust valves (also not shown) on the cylinder head 20.

Figure 2:
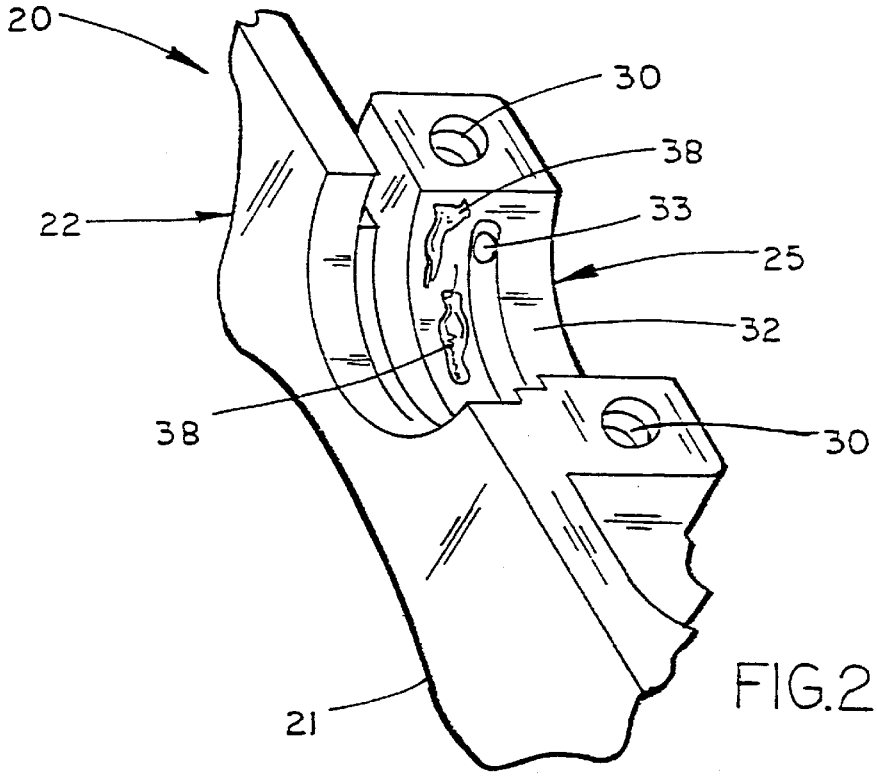
FIG. 2 is an enlarged perspective view of a bottom housing portion of the damaged front bearing shown in FIG. 1, the front bearing structure having the bearing cap (not specifically shown) having a similarly damaged surface.

As an engine is used, the bearing surfaces 31 and 32 (FIG. 1) and/or the journals 24 can become worn, such that the cam shaft 24 no longer is accurately held and such that the cam shaft 23 begins to vibrate during operation. In a worse case scenario, the material of the bearing surfaces 31 or 32 can become galled or scored, resulting in severe material removal and/or freezing of the cam shaft 23 in the cam housings 22. This is illustrated at locations 38 in FIG. 2 on the bearing surface 32 of the bottom half 25. The present invention provides an insert 27, repair methods, and tools that can be used to rebuild a worn cam housing 22, as described below.

It is noted that many cylinder heads in modern vehicle engines are being made from aluminum and other alloys to reduce weight. Sometimes these new materials are not strong or durable enough to provide the service life desired. Also, many cylinder heads have reduced mass and structure, such that some new designs require a reinforcement in high stress areas, such as in the cam shaft bearings. Still further, modern vehicles are being operated longer and a corresponding increase in engine life is desired. It is contemplated that the present bearing insert 27, repair methods, and tools are useable in each of these circumstances.

Figures 7, 8, 9, 9A, 10:
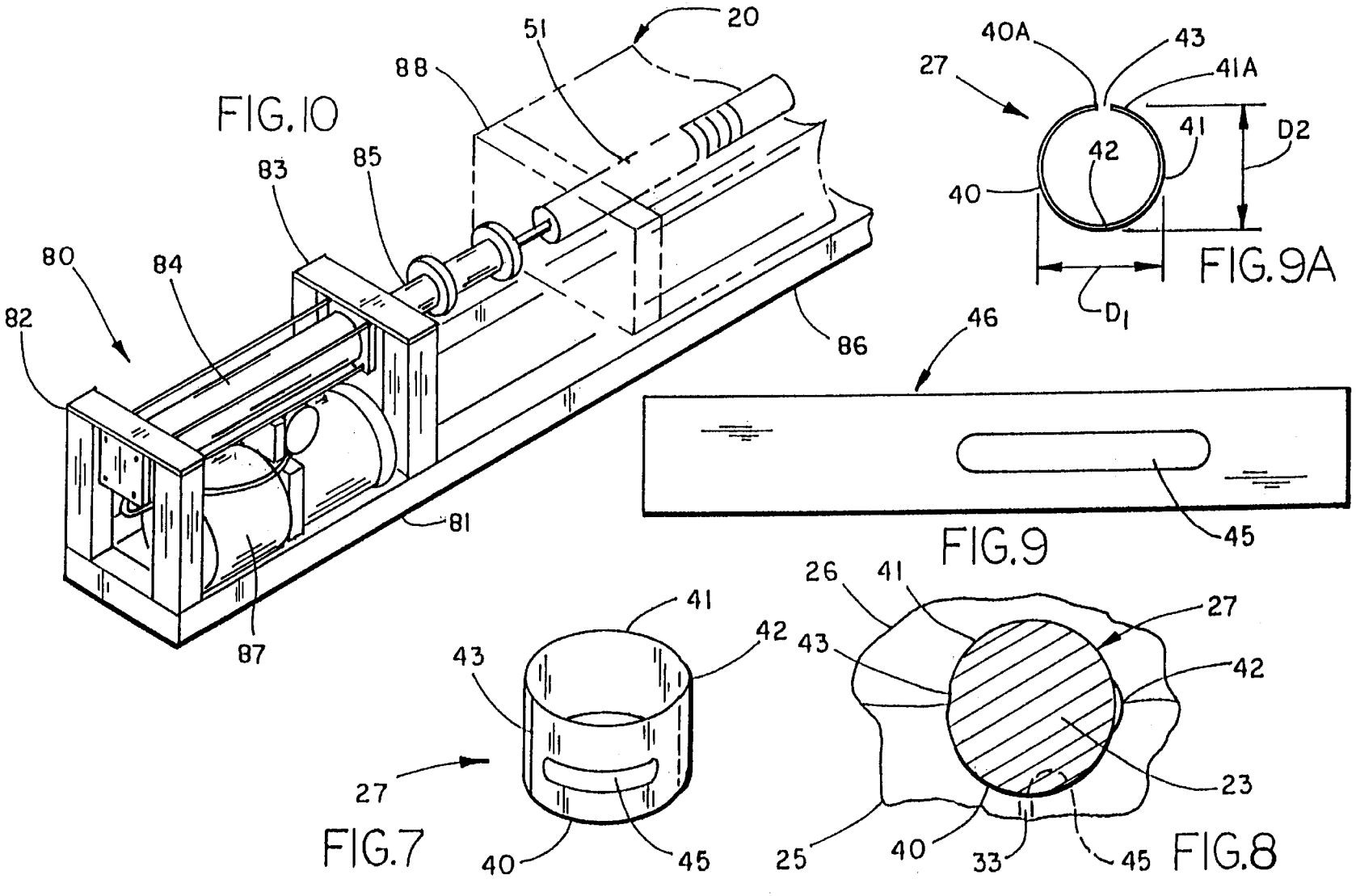
FIG. 7 is a perspective view of a cam shaft bearing insert after the bearing insert has been installed in a cam shaft housing and after the outward protruding minor section has been deformed and has taken a set.
FIG. 8 is an end view of the bearing insert shown in FIG. 7 as installed in a cam shaft housing.
FIG. 9 is a plan view of a blank of thin sheet material for forming the insert shown in FIG. 7.
FIG. 9A is an end view of the blank from FIG. 9 formed into a generally circular shape, but that is slightly oval in shape and that is slightly open at its slit.
FIG. 10 is a side perspective view similar to FIG. 4, but showing a modified bench-type broach puller.

Bearing insert 27 (FIG. 7) is provided for positioning in an oversized reformed cam housing 22 to reform or rebuild a cam housing 22. The insert 27 is made from a phosphor bronze alloy having high durability and excellent properties for use as a bearing. When installed (see FIG. 8), the insert 27 is forced to take on a closed ring shape with opposing semi-cylindrical portions 40 and 41 joined by a short bulging section 42 on one side and a closed slit 43 on the other side. The short section 42 extends outwardly slightly from the circle of semi-cylindrical portions 40 and 41, and is configured to engage a mating recess 44 (FIG. 6) located in the cam housing 22, such as at a joint line between bearing surfaces 31 and 32. The short section 42 is formed when the insert 27 is clamped in place in the cam housing 22 between housing halves 25 and 26. A length of the blank 46 is closely controlled so that when edges 40A and 41A abut, there is excess material along a length of the bearing insert 27. Therefore, as the cap half 26 is fully tightened, the short section 42 bulges outwardly to engage the recess 44 to act as an anti-rotation device to provide additional resistance against the torsional forces of the journals 24 as the cam shaft 23 rotates within the bearing insert 27 on cam housings 22. The forces are sufficient, such that after installation, the short section 42 takes on a permanent set, as shown in FIG. 7. An oil port 45 is formed in a center of the illustrated semi-cylindrical portion 40 and extends circumferentially about halfway toward each end of the semi-cylindrical portion 40 or, in other words, about a total of 90 degrees in the insert 27. Notably, the oil port 45 can be a single hole, two holes, a circumferential slot, a longitudinal slot, a "tear drop" shape, or any other configuration required for a particular cam housing design.

The illustrated bearing insert 27 is one piece and is preferably made from a blank 46 (FIG. 9) of flat stock of surface hardened phosphor bronze alloy material similar to that in the insert of U.S. Pat. No. 4,768,479, which has excellent memory and bearing properties. The blank 46 can be made in various ways, but in a preferred form the blank 46 is stamped and formed into a sleeve-like cylindrical shape close to the shape of bearing insert 27. It is contemplated that the alloy material and thickness of the material of the blank 46 can be optimized for particular applications. Nonetheless, the illustrated insert 27 has a wall thickness of less than about 0.032 inches, and preferably that is about 0.008 inches to 0.020 inches, and most preferably that is about 0.016 inches. Further, the insert 27 is sized to a diameter and length of a cam shaft journal, such as any where from about a 1.00 inch diameter to about a 2.00 inch diameter, and about 0.50 inches long to about 1.00 inches long for a journal for a cam shaft in an internal combustion engine. The illustrated insert 27 is about one inch in diameter and is about ½ inch long. As formed, the insert 27 is formed with the slit 43 slightly opened up about ⅛ inches. The insert 27 is also formed to be slightly oblong or oval, such as about 0.125 inches longer in the dimension D1 than in the dimension D2 (FIG. 9A). This oblong shape and the squareness of edges 40A and 41A cause edges 40A and 41A to abut on the cam shaft journal 24 during installation, thus preventing problems with overlapping of edges 40A and 41A during installation. Further, wall of the insert 27 is resilient, such that the insert 27 can be flexed toward a more open condition and thereafter flexed to a more closed condition without kinking or breaking the insert 27. This allows the insert 27 to be flexed open, such that the insert 27 can be snapped onto any one of the journals 24 from a side of the cam shaft 23 without unacceptable distortion of the insert 27. This is advantageous because the valve cams 36 and 37 (FIG. 1) are often larger than the journals 24. Thus, the flexible insert 27 can be easily manually flexed and positioned on the cam shaft 23, even where the valve cams 36 and 37 are so large as to prevent slipping the insert 27 into position from an end of the cam shaft 23. After positioning the insert(s) 27 on the journal(s) 24 of the cam shaft 23, the cam shaft 23 is set onto the bottom halves 25 with the oil ports 45 of each insert 27 being accurately aligned on the oil ports 33 on the bottom halves 25.

Figure 3A:
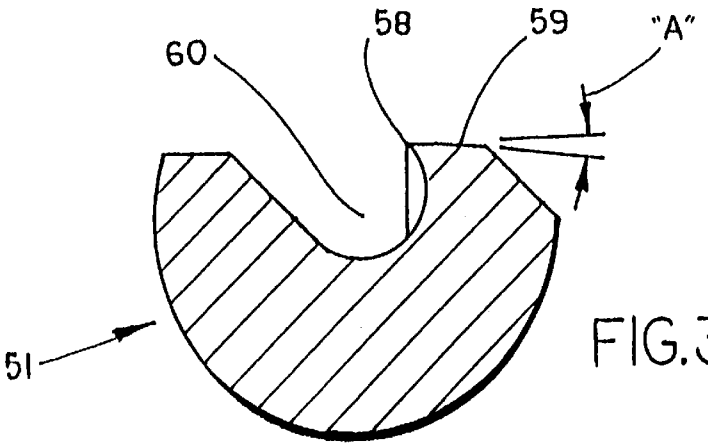
FIG. 3A is an enlarged side view of the circled area IIIA in FIG. 3.
Figure 3:
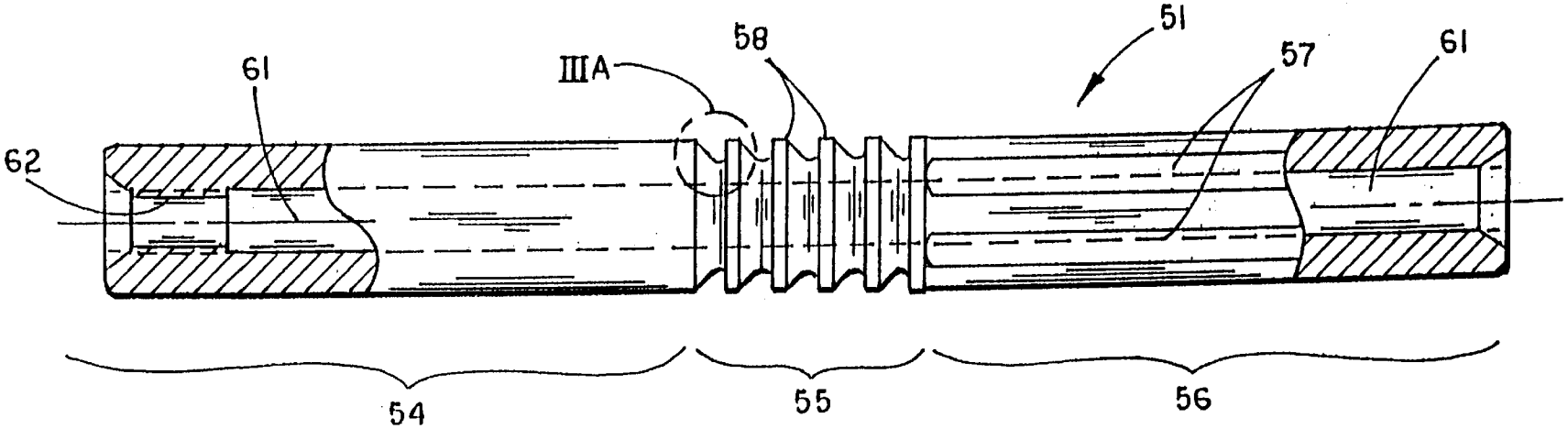
FIG. 3 is a side view of an elongated broach for broaching aligned cam shaft housings.

Broach apparatus 50 (FIG. 4) includes a broach 51 and a motivating device that comprises a broach puller 52 and a puller holder 53. The broach 51 is elongated and rod shaped and includes a lead section 54, a cutting section 55, and a tail section 56. The lead and tail sections 54 and 56 are configured to guide the broach 51 through the aligned holes in the cam housings 22, while accurately maintaining alignment of the broach 51 with an axial centerline of the cam housings 22. Optimally, the lead section 54 has a diameter about equal to the diameter of the aligned holes in the cam housings 22 before they are broached by the cutting section 55. Also, the tail section 56 has a diameter about equal to the diameter of the aligned holes in the cam housings 22 after they are broached by cutting section 55. The illustrated tail section 56 has longitudinally extending relief areas 57 formed therein to reduce a risk of the tail section 56 dragging clips to scoring, marking, or scratching the recut aligned holes in the cam housings 22 as the tail section 56 is pulled therethrough. The cutting section 55 includes multiple circular knife edges 58, five to eight of which are illustrated. Each knife edge 58 (FIGS. 3 and 3A) is followed by a ring-shaped marginal surface 59 extending downstream of the knife edges 58. The marginal surfaces 59 extend at an inward angle "A" from the knife edges 58, and provide relief for the recut bearing surfaces 31 and 32 after each knife edge 58 passes over the bearing surfaces 31 and 32. A relatively large ring-shaped undercut recess 60 is provided ahead of each knife edge 58 for receiving chips and cutaway material from the bearing surfaces 31 and 32. A hole 61 extends through broach 51 from end to end and includes a threaded section 62 in the lead section 54. The threaded section 62 includes Acme threads that are chosen to be relatively resistant to damage and resistant to binding from debris that may get into the threads. Nonetheless, it is contemplated that other threads could be used and still satisfy the functional requirements of the design.

Figure 4:
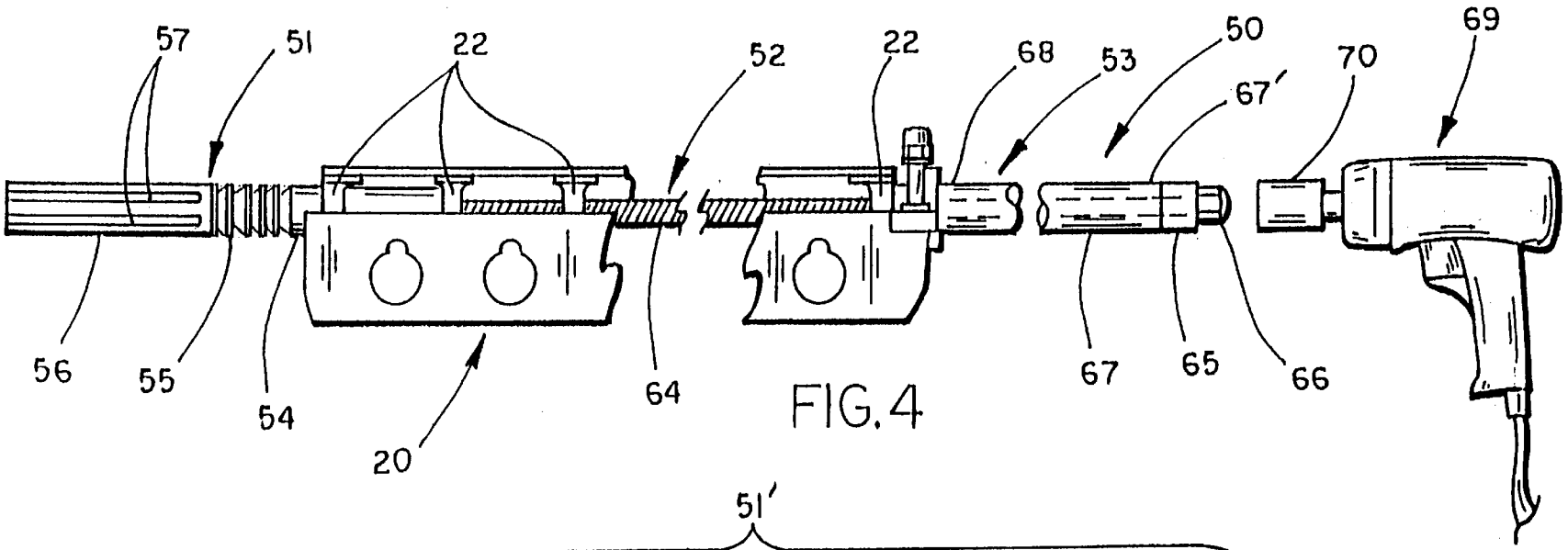
FIG. 4 is a side view of the cylinder head, partially broken away (shown in FIG. 1), with the broach (shown in FIG. 3) positioned in the aligned bearing support structure, ready to begin the broaching process.

The broach puller 52 (FIG. 4) includes an elongated threaded rod 64 shaped to threadably engage the thread section 62 in the broach. The broach puller 52 further includes a thrust bearing 65 and an enlarged hex head 66. The puller holder 53 includes a tube 67 shaped to closely receive the threaded rod 64, and further includes a first end 67' shaped to abuttingly engage the thrust bearing 65 and a second end 68 shaped to abuttingly and stably engage an end of the cylinder head 20. As shown in FIG. 4, the broach apparatus 50 is configured so that the broach 51 can be positioned in one end with the lead section 54 positioned in a first couple of the aligned cam housings 22 at one end of the cylinder head 20. The rod 64 of the broach puller 52 is extended through the puller holder 53 at the other end of the cylinder head 20, through all of the cam housings 22 and threadably into the broach 51. An air impact wrench 69 with a socket 70 shaped to engage the hex head 66 of the broach puller 52 can be used to rotate the broach puller 52 to pull the broach 51 through the cam housings 22 of the cylinder head 20. The puller holder 53 abuts the thrust bearing 65 and the enlarged head 66 of the puller 52 and also abuts the end of the cylinder head 20, such that the broach 51 is forcibly pulled through the cylinder head 20 as the broach puller 52 is rotated. Further, it is noted that the puller holder 53 can be grasped by the repairman for stabilizing the arrangement during the manual broaching process.

A method of manual broaching the cam housings 22 of a cylinder head 20 is performed as follows. Initially, the cam bearing support structures or cam housings 22 are measured for warp. If the range of misalignment is too great, the cylinder head 20 is first straightened. Such procedures are known in the art. Next, the cam housings 22 are inspected for galling. If any of the cam housings 22 have galling (see FIG. 2), the damaged cam housing 22 can be repaired with epoxy putty, as noted below. The housing caps 26 are secured to the bearing bottom half 25 by torquing attachment bolts that extend through the tubular protrusions 29 threadably into the holes 30 to an appropriate specification, e.g., to about 16 ft/lbs. The lead section 54 of the broach 51 (FIG. 4) is placed in the last two cam housings 22 from a rear of the cylinder head 20. The broach puller 52 and puller holder 53 are placed on an end of the cylinder head 20, with an end of the rod 64 threaded into the broach 51. A liberal amount of lubricant, such as WD-40, is applied to all bearing housings 22 and to the broach 51. Using the air impact wrench 69 to rotate the broach puller 52, the broach 51 is pulled through the housings 22. The combination of the lead and tail sections 54 and 56 keep the broach 51 accurately aligned in the cam housings 22 as the cutting section 55 of the broach 51 reforms the cam housings 22. Normally, it is contemplated that all cam housings 22 will be broached at a single time, although it is contemplated that a single cam housing 22 can be broached by pulling the broach 51 only far enough to reform the single cam housing 22.

Figure 5:
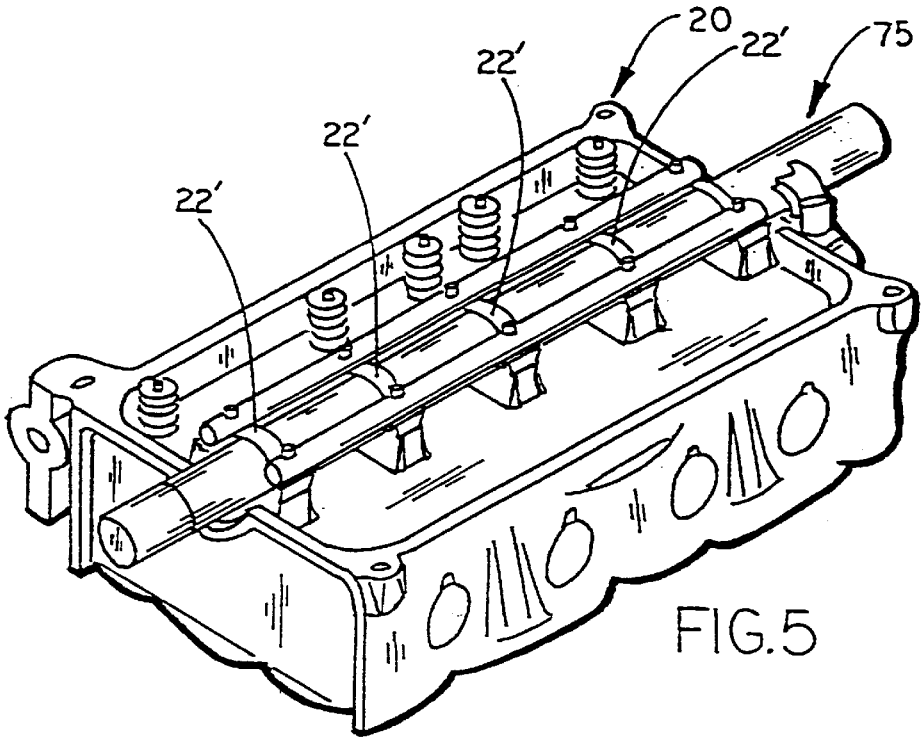
FIG. 5 is a perspective view of the cylinder head after broaching and after filling galled areas with an epoxy filler, and including a release-agent coated sizer rod positioned in the bearing support structure to form the epoxy filler to a predetermined size.

Severely galled cam housings 22 can be repaired as follows. The galled housing halves 25 and 26 (FIG. 6) are ground with a handheld die grinder and/or are broached to a depth of about 0.020 to 0.050 inches below the original housing surface. A shaft mold 75 (FIG. 5) is provided having a section with a particular diameter that has a release-agent coated or Teflon coated area corresponding to the cam housings 22. The coated area of the rod-shaped shaft mold 75 has the desired final diameter of the repaired cam housings 22'. A suitable polymeric filler 76, such as Devcon Titanium Putty, is mixed and applied to the ground cam housing 22 (or to the coated area on the shaft mold 75). With the housing caps 26 off, the shaft mold 75 is cradled in the cam housings 22. The housing caps 26 are then reattached to the bearing base 25, and the cap attachment bolts are appropriately torqued to a specification, e.g., about 16 ft/lbs. The putty is allowed to dry for an appropriate time, such as about four hours. Then the top caps 26 are disassembled and any excess putty is ground off. (See FIG. 6, which shows repaired surfaces 31' and 32' on the top cap 26 and bottom half 25.) The oil ports 33 are cleaned out, such as with a hand drill.

To install the inserts 27 (FIG. 1), the bearing inserts 27 are flexed open and snapped onto journals 24 of a cam shaft 23, either from a side thereof or over an end of the cam shaft 23. The cam shaft 23 is then positioned on the surface 32 of the bottom half 25 of the cam housing 22, making certain that the oil slot 45 is aligned with the oil port 33 on the bottom half 25 of the cam housing 22. The top caps 26 are placed in their order and assembled to the bottom halves 25 of the cylinder head 20, including torquing them to an appropriate torque specification, e.g., 16 ft/lbs. The cam housing repair is complete.

It is contemplated that modifications can be made to the present inventive concepts while still being included in the present invention. For example, a bench-type broaching apparatus 80 (FIG. 10) can be used in place of the air impact wrench 69. The bench-type apparatus 80 includes a stand 81 with spaced-apart blocks 82 and 83 holding a hydraulic cylinder 84, and a stop 88 spaced from the front block 83. An extendable/retractable rod 85 extends from the cylinder 84 and through the second block 83 and also through the stop 88 into an area where a cylinder head 20 is supported on a stand 86 against the stop 88. A hydraulic fluid powering system 87 is attached to the cylinder 84 for motivating the extendable/retractable rod 85. The broach 51 is positioned in the cylinder head 20 and is threadably connected to an end of the rod 85. The broach 51 is pulled through the cylinder head 20 by operating the powering system 87 to move the broach 51. It is contemplated that a semi-automatic powering system could also be configured to rotate, so that it could be used to rotate the broach puller 52 to pull the broach 51 by use of the rod 64.

Figure 11:
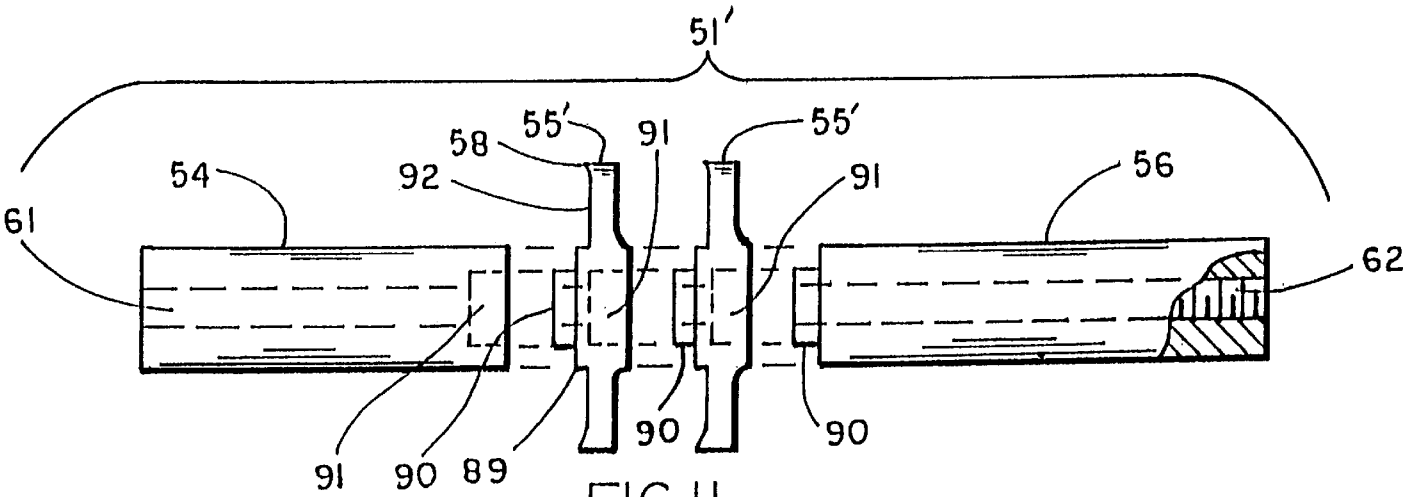
FIG. 11 is a side view of a modified broach similar to that shown in FIG. 3, but including multiple replaceable cutting sections forming the broaching tool.

In yet another modification, a modified broach 51 (FIG. 11) is provided with replaceable cutter sections 55'. It is contemplated that the cutter sections 55' can be separate cutter rings as shown or can be a single modular unit. The illustrated cutter sections 55' include a center body 89 having a nose 90 shaped to closely mateably engage a recess 91 on the structure upstream from the nose 90, and further includes a recess 91 for receiving the nose 90 on a downstream adjacent structure. The cutter knife edges 58 extend from the structural rings 92 that extend radially from the center body 89. In the illustrated modified broach 51', the tail section 56' is threaded. Thus, the tail section 56' compresses the assembly of the lead, cutter, and tail sections 54', 55', and 56', respectively, as the rod 64 the broach 51' is pulled through the cam housings 22. Alternatively, the noses 90 and the recesses 91 can be threaded or friction fit to retain them together. In still another alternative, a long tubular mandrel (not specifically shown) extending from the lead section to the tail section (or visa versa) can be used to mount the cutter sections 55'.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A cam shaft bearing insert for use in an internal combustion engine, the engine including a cylinder head and a cam shaft rotatably supported by the cylinder head at multiple aligned bearing locations, the cylinder head including a bearing support structure at each of the bearing locations and having an oil port in each bearing support structure for passing oil to the associated bearing location, comprising:

a thin-walled cylindrical sleeve formed from thin flat stock into a cylindrical tubular shape that is adapted to fit into a selected one of the bearing support structures and form a bearing suitable for operably engaging and supporting the cam shaft, the sleeve having an outer surface shaped to non-rotatably engage the one bearing support structure and having an aperture therein so that, when the aperture is aligned with the oil port of the one bearing support structure, oil can pass from the oil port to the associated bearing location; and the sleeve including a wall with a longitudinally extending slit that extends between abutting opposing edges of the sleeve, and wherein the wall of the sleeve is resiliently flexible, such that the wall can flex to spread apart the abutting edges and to open the slit for positioning the sleeve on a journal of the cam shaft, and further such that the wall can reversely flex thereafter to fit tightly into the bearing support structure.

2. The bearing insert defined in claim 1, wherein the sleeve has a thickness of less than about 0.032 inches and is flexible to facilitate installation.

3. The bearing insert defined in claim 2, wherein the sleeve has a thickness of less than about 0.016 inches.

4. A cam shaft bearing insert for use in an internal combustion engine, the engine including a cylinder head and a cam shaft rotatably supported by the cylinder head at multiple aligned bearing locations, the cylinder head including a bearing support structure at each of the bearing locations and having an oil port in each bearing support structure for passing oil to the associated bearing location, comprising:

a thin-walled cylindrical sleeve formed from thin flat stock into a cylindrical tubular shape that is adapted to fit into a selected one of the bearing support structures and form a bearing suitable for operably engaging and supporting the cam shaft, the sleeve having an outer surface shaped to non-rotatably engage the one bearing support structure and having an aperture therein so that, when the aperture is aligned with the oil port of the one bearing support structure, oil can pass from the oil port to the associated bearing location, the sleeve having a thickness of less than about 0.016 inches and being flexible to facilitate installation, and wherein the sleeve has a diameter less than a longitudinal length of the sleeve.

5. The bearing insert defined in claim 1, wherein the aperture is positioned closer to one of the edges than the other of the opposing edges.

6. A cam shaft bearing insert for use in an internal combustion engine, the engine including a cylinder head and a cam shaft rotatably supported by the cylinder head at multiple aligned bearing locations, the cylinder head including a bearing support structure at each of the bearing locations and having an oil port in each bearing support structure for passing oil to the associated bearing location, comprising:

a thin-walled cylindrical sleeve formed from thin flat stock into a cylindrical tubular shape that is adapted to fit into a selected one of the bearing support structures and form a bearing suitable for operably engaging and supporting the cam shaft, the sleeve having an outer surface shaped to non-rotatably engage the one bearing support structure and having an aperture therein so that, when the aperture is aligned with the oil port of the one bearing support structure, oil can pass from the oil port to the associated bearing location wherein the sleeve, as installed, includes an outwardly deformed section that is configured to frictionally engage the one bearing support structure to provide an antirotation feature.

7. The bearing insert defined in claim 1, wherein the sleeve is made from a bronze alloy material.

8. A cam shaft bearing insert for use in an internal combustion engine, the engine including a cylinder head and a cam shaft rotatably supported by the cylinder head at multiple aligned bearing locations, the cylinder head including a bearing support structure at each of the bearing locations and having an oil port in each bearing support structure for passing oil to the associated bearing location, comprising:

a thin-walled cylindrical sleeve formed from thin flat stock into a cylindrical tubular shape that is adapted to fit into a selected one of the bearing support structures and form a bearing suitable for operably engaging and supporting the cam shaft, the sleeve having an outer surface shaped to non-rotatably engage the one bearing support structure and having an aperture therein so that, when the aperture is aligned with the oil port of the one bearing support structure, oil can pass from the oil port to the associated bearing location, wherein the sleeve has a constant transverse cross section along its length that approximates a circle, but that in its preformed, pre-installed, unstressed state is deformed at least partially toward an oval shape.

9. The bearing insert defined in claim 1, wherein the aperture is circumferentially elongated.

10. The bearing insert defined in claim 1, wherein the aperture comprises a slot that extends circumferentially around the sleeve a first dimension that is at least twice a perpendicular second dimension of the aperture.

11. In an internal combustion engine, the engine including a cylinder head and a cam shaft rotatably supported by the cylinder head at multiple aligned bearing locations, the cylinder head including a bearing support structure at each of the bearing locations, an improvement comprising:

a thin-walled cylindrically shaped bearing insert formed from thin flat stock into a cylindrical tubular shape that is adapted to fit into one of the bearing support structures and form a bearing surface suitable for engaging and operably supporting the cam shaft, the sleeve having a deformable wall that, as installed, includes a cylindrically shaped major section and an outwardly formed minor section, the outwardly formed minor section being configured to non-rotatably engage the one bearing support structure.

12. An internal combustion engine, comprising:

a cylinder head;

a cam shaft rotatably supported by the cylinder head at multiple aligned bearing locations, the cylinder head including a bearing support structure at each of the bearing locations; and a resilient cylindrical sleeve positioned in one of the bearing locations and rotatably engaging the cam shaft, the sleeve being formed from thin flat stock into a cylindrical tube with a longitudinal slit, the sleeve being made from material suitable to form a durable bearing for the cam shaft, but further that is resilient so that the sleeve can flex to open up the slit, allowing the sleeve to slip onto the cam shaft at a selected one of the bearing locations, and to then reversely flex to fit into a selected one of the bearing support structures.

* * * * *